US009625147B2

(12) United States Patent
Kato et al.

(10) Patent No.: US 9,625,147 B2
(45) Date of Patent: Apr. 18, 2017

(54) COMBUSTION HEATER

(75) Inventors: Soichiro Kato, Yokohama (JP); Katsuyoshi Takahashi, Tokyo (JP); Taku Mizutani, Yokohama (JP)

(73) Assignee: IHI CORPORATION (JP)

( * ) Notice: Subject to any disclaimer, the term of this patent is extended or adjusted under 35 U.S.C. 154(b) by 810 days.

(21) Appl. No.: 12/812,889

(22) PCT Filed: Jan. 30, 2009

(86) PCT No.: PCT/JP2009/051654
§ 371 (c)(1),
(2), (4) Date: Jul. 14, 2010

(87) PCT Pub. No.: WO2009/096562
PCT Pub. Date: Aug. 6, 2009

(65) Prior Publication Data

US 2011/0048412 A1 Mar. 3, 2011

(30) Foreign Application Priority Data

Feb. 1, 2008 (JP) ..... P2008-022974
Feb. 1, 2008 (JP) ..... P2008-022975

(51) Int. Cl.
*F24C 3/00* (2006.01)
*F23D 14/12* (2006.01)
(Continued)

(52) U.S. Cl.
CPC ..... *F23D 14/125* (2013.01); *F23C 3/002* (2013.01); *F23D 14/045* (2013.01); *F23D 14/10* (2013.01);
(Continued)

(58) Field of Classification Search
CPC .... F23C 3/002; F23C 3/00; F23C 5/02; F23C 5/08; F23C 5/28; F23C 2900/03006;
(Continued)

(56) References Cited

U.S. PATENT DOCUMENTS 782,735 A * 2/1905 Eickemyer ..... 126/85 R
1,735,945 A 11/1929 Wollaston
(Continued)

FOREIGN PATENT DOCUMENTS

CN 1498327 A 5/2004
CN 1860334 A 11/2006
(Continued)

OTHER PUBLICATIONS

Japanese Office Action and English translation dated Oct. 2, 2012 in corresponding Japanese Patent Application No. JP 2008-022974.
(Continued)

*Primary Examiner* — Avinash Savani
*Assistant Examiner* — Aaron Heyamoto
(74) *Attorney, Agent, or Firm* — Ostrolenk Faber LLP

(57) ABSTRACT

A combustion heater includes an inner tube having a supply passage for combustion gas in an inner portion, and an outer tube disposed to provide a separated combustion space in an outer periphery of the inner tube. A hole part for ejecting the combustion gas is formed on a tube wall of the inner tube and combustion gas is ejected with ejection characteristics such that circulating flow is formed on the periphery of a stagnation point. According to this combustion heater, a stable flame can be formed without increasing costs and the heating efficiency can be improved.

17 Claims, 11 Drawing Sheets

(51) Int. Cl.

| | |
|---|---|
| ***F23C 3/00*** | (2006.01) |
| ***F23D 14/04*** | (2006.01) |
| ***F23D 14/10*** | (2006.01) |
| ***F23D 14/84*** | (2006.01) |

(52) U.S. Cl.
CPC ..... *F23D 14/12* (2013.01); *F23D 14/84* (2013.01); *F23C 2900/03006* (2013.01); *F23D 2203/1012* (2013.01)

(58) Field of Classification Search
CPC .... F23C 2203/10; F23D 14/045; F23D 14/10; F23D 14/125; F23D 14/84; F23D 14/105; F23D 14/12; F23D 14/70
USPC ..... 126/91 A, 85 R; 431/176
See application file for complete search history.

(56) References Cited

U.S. PATENT DOCUMENTS

| | | | | |
|---|---|---|---|---|
| 2,539,512 | A * | 1/1951 | Herbert et al. | 126/85 R |
| 2,632,503 | A * | 3/1953 | Bailey | 122/6.5 |
| 2,869,630 | A * | 1/1959 | Flynn | 431/280 |
| 3,174,474 | A | 3/1965 | Jones et al. | |
| 3,187,740 | A * | 6/1965 | Jones et al. | 126/91 A |
| 3,217,701 | A * | 11/1965 | Weiss | 126/92 B |
| 3,220,401 | A * | 11/1965 | Jones et al. | 126/91 A |
| 3,229,747 | A * | 1/1966 | Ayers | 431/347 |
| 3,291,190 | A * | 12/1966 | Radley | 239/394 |
| 3,334,820 | A * | 8/1967 | Flynn | 239/556 |
| 3,688,760 | A * | 9/1972 | Rudin | 126/91 A |
| 4,649,903 | A * | 3/1987 | Takeuchi | F24J 2/055 126/653 |
| 4,652,236 | A * | 3/1987 | Viessmann | 431/350 |
| 4,809,672 | A * | 3/1989 | Kendall et al. | 126/91 A |
| 5,241,949 | A | 9/1993 | Collier | 126/91 |
| 5,255,742 | A | 10/1993 | Mikus | |
| 5,267,609 | A | 12/1993 | Olsson | 165/133 |
| 5,932,885 | A * | 8/1999 | DeBellis et al. | 250/493.1 |
| 6,321,743 | B1 * | 11/2001 | Khinkis et al. | 126/91 A |
| 6,428,313 | B1 * | 8/2002 | Rodgers et al. | 431/354 |
| 7,168,949 | B2 * | 1/2007 | Zinn et al. | 431/350 |
| 7,425,127 | B2 * | 9/2008 | Zinn et al. | 431/9 |
| 2002/0015670 | A1 * | 2/2002 | Shah et al. | 422/198 |
| 2002/0055079 | A1 * | 5/2002 | Wood et al. | 431/354 |
| 2006/0248800 | A1 * | 11/2006 | Miglin et al. | 48/198.7 |
| 2008/0244973 | A1 * | 10/2008 | Higashino | 48/127.9 |
| 2009/0061374 | A1 * | 3/2009 | De Jong | 431/354 |

FOREIGN PATENT DOCUMENTS

| | | | |
|---|---|---|---|
| GB | 502112 | A | 3/1939 |
| JP | 53-146337 | | 12/1978 |
| JP | 61-147009 | | 7/1986 |
| JP | 61-272517 | | 12/1986 |
| JP | 53-146337 | | 12/1987 |
| JP | 02-052913 | | 2/1990 |
| JP | 02052913 | A * | 2/1990 |
| JP | 2-150608 | | 6/1990 |
| JP | 02-178507 | | 7/1990 |
| JP | 04-138516 | | 12/1992 |
| JP | 5-90119 | | 12/1993 |
| JP | 6-229522 | | 8/1994 |
| JP | 6-241419 | | 8/1994 |
| JP | 7-133912 | | 5/1995 |
| JP | 8-315656 | | 11/1996 |
| JP | 2001-280615 | | 10/2001 |
| JP | 2002-349807 | | 12/2002 |
| JP | 2007-32886 | | 2/2007 |
| RU | 2 057 989 | | 4/1996 |
| SU | 424893 | | 4/1974 |
| TW | 403824 | B | 9/2000 |
| WO | WO 02/075212 | A1 | 9/2002 |

OTHER PUBLICATIONS

Japanese Office Action and English translation dated Oct. 2, 2012 in corresponding Japanese Patent application No. JP 2008-022975.
Examination Report dated Dec. 14, 2011 issued in corresponding Taiwan Patent Application No. 098103180 with English translation (8 pages).
Office Action dated Jan. 23, 2012 issued in corresponding Russian Patent Application No. 2010133543/6 with English translation (13 pages).
Office Action dated Mar. 5, 2012 issued in corresponding Korean Patent Application No. 10-2010-7017723 with English translation (15 pages).
International Search Report and Written Opinion mailed Apr. 14, 2009 in corresponding PCT International Application No. PCT/JP2009/051654.
Extended European Search Report and European Search Opinion dated Oct. 21, 2015 in corresponding European Patent Application No. 09706786.2 (7 pages).

* cited by examiner

COMBUSTION HEATER

CROSS-REFERENCE TO RELATED APPLICATIONS

The present application is a 35 U.S.C. §§371 national phase conversion of PCT/JP2009/051654, filed Jan. 30, 2009, which claims priority of Japanese Patent Application Nos. 2008-022974 and 2008-022975, both filed Feb. 1, 2008, the contents of which are incorporated herein by reference. The PCT International Application was published in the Japanese language.

TECHNICAL FIELD

The present invention relates a combustion heater that combusts a premixed gas of a fuel gas and combustion air.

BACKGROUND ART

Conventionally, a radiant tube burner has been manufactured in which a completely premixed gas of a fuel gas and combustion air is combusted in a heat-resistant round tube (radiator tube) to thereby use the resulting flame to cause the radiator tube to be red hot. Such the radiant tube burner is used as an elongated heat source without exposure of a flame in heating furnaces and heaters. Furthermore a combustion burner is known in which combustion gas is combusted in an inner tube and a direction of flow is varied by collision of a jet of combustion gas with a shield surface disposed orthogonally thereto to thereby extract heat from the radiator tube.

In this type of combustion heater, since combustion is terminated midway in the radiator tube, disadvantages include the fact that there are difficulties to obtain a uniform temperature distribution along the entire tube length, and the fact that a large amount of nitrogen oxides (NOx) is produced. In Patent Literature 1, a combustion heater is disclosed which includes a porous tube having an inner section acting as a supply passage for a premixed gas, and a radiator tube disposed coaxially to the outer periphery of the porous tube. A premixed gas is ejected radially from the porous tube and forms laminar flow. Combustion of the premixed gas is executed on a cylindrical surface between the radiator tube and the porous tube on which the rate of flow of the premixed gas balances the flame propagation speed to thereby obtain a higher uniform temperature on the whole of the radiator tube and facilitate high heat generation and low NOx production.

[Patent Literature 1] Japanese Patent Application, First Publication No. 6-241419

DISCLOSURE OF THE INVENTION

Problem to be Solved by the Invention

However the conventional techniques above entail the following problems.

Unless a separate flame holding mechanism is provided separately, continuous balance of the flow velocity of the premixed gas and the combustion speed is difficult. Furthermore there is a position-dependent deviation in the flow speed and flow amount of the premixed gas flowing out from a porous body and therefore it is difficult to form a stable tube-shaped flame.

Since a tube-shaped flame is formed at a position which is separated from the radiator tube, extraction of heat through the radiator tube is difficult and heating efficiency may be reduced.

Furthermore since the above technique requires the provision of a porous tube in a portion of an inner tube, problems are caused in that manufacturing processes are complicated and costs are increased.

The present invention is proposed in view of the points above and has the object of providing a combustion heater which form a stable flame and which improves heating efficiency without causing cost increases.

Means for Solving the Problem

The present invention is configured in the manner below in order to achieve the above object.

A combustion heater according to the present invention includes an inner tube having a supply passage for combustion gas in an inner portion, and an outer tube disposed to provide a separated combustion space in an outer periphery of the inner tube. A hole part for ejecting the combustion gas is formed on a tube wall of the inner tube. A stagnation point for combustion gas is formed in the combustion space and the flow of combustion gas in the combustion space is set to form a circulating flow about the periphery of the stagnation point.

The invention adopts the following configuration as an actual configuration for achieving the above object.

A combustion heater according to the present invention includes an inner tube having a supply passage for combustion gas in an inner portion, and an outer tube disposed to provide a separated combustion space in an outer periphery of the inner tube. A hole part for ejecting the combustion gas is formed on a tube wall of the inner tube. A stagnation point for combustion gas is formed on an inner peripheral face of the outer tube and combustion gas is ejected with ejection characteristics that form a circulating flow about the periphery of the stagnation point.

In a combustion heater that has the above ejection characteristics, formation and maintenance of a stable flame is facilitated (in other words, without causing cost increases) by igniting (lighting) combustion gas in the periphery of a stagnation point where the flow speed is approximately zero. Furthermore since a circulating flow is formed about the periphery of the stagnation point, stable combustion is realized. In the conventional example, when a gas flow amount increases, a discharge route for combustion gas cannot be ensured and there is the possibility that the stability of the flame will be reduced. In contrast, the present invention forms and retains a stable flame on an inner peripheral face of the outer tube.

When the inner tube and the outer tube are disposed concentrically and the hole part is disposed at a position at which the stagnation point is formed at a specific position on an inner peripheral face of the outer tube, a flame can be stabilized, formed and maintained at the specific position on the inner peripheral face of the outer tube.

The outer peripheral face of the inner tube includes a first region in which a distance to the inner peripheral face of the outer tube is shortest, and a second region in which the distance is longer than the first region. When the hole part is formed in the first region in which a distance to the inner peripheral face of the outer tube is short, the discharge route for combustion gas can be ensured between the inner peripheral face of the outer tube and the second region including the region on the opposite side to the first region.

In the present invention, since a flame can be formed and maintained at the stagnation point on the inner peripheral face of the outer tube, efficient heating through the outer tube is possible.

The inner tube is disposed at an arbitrary position with respect to the outer tube. When the inner tube is disposed eccentrically, it is preferred that a configuration is adopted in which the hole part is formed in an outer peripheral face positioned in an eccentric direction with respect to the inner tube. In this manner, in the present invention, facilitates formation of the first region which has a short distance between the inner peripheral face of the outer tube and the outer peripheral face of the inner tube is formed easily.

The following description of a means for solution of the problem is related to the situation in which the inner tube is disposed in an eccentric orientation to the outer tube.

A configuration is also preferably adopted in which a plurality is disposed at an interval in a peripheral direction about the axial center of the inner tube.

In this manner, in the present invention, a plurality of flames can be formed and retained at an interval in a peripheral direction with respect to the inner peripheral face of the outer tube, and thereby more efficient heating is possible.

In the present invention, when the inner tube is disposed eccentrically, a configuration is preferably adopted in which a second hole part for ejecting combustion gases to a position separated from the stagnation point is disposed at a position separated from the first region in the inner tube.

In this manner, in the present invention, propagation of a flame, that is formed and retained at a stagnation point, is enabled into the combustion gas ejected from the second hole part. Consequently, in the present invention, the pressure loss resulting from use of a porous body can be avoided. Furthermore since the introduced amount of heat can be increased without increasing the length of the inner tube and the outer tube, it is possible to prevent an increase in the size of the device resulting for example from increasing the length of the inner tube and outer tube. In the present invention, since pressure loss can be suppressed, application is possible to low-pressure city gas lines.

The second hole part preferably adopts a configuration in which the second hole part is disposed on both sides sandwiching the first region and is disposed alternately with the hole part along the first region.

In this manner, in the present invention, it is possible to form and maintain a flame and to produce a flame propagation with equal distribution.

The present invention preferably adopts a configuration in which a supporting member supports a distal end of the inner tube, that is cantilever supported at a base end, between the inner tube and the outer tube, and maintains an interval between the outer peripheral surface of the inner tube and the inner peripheral surface of the outer tube. The supporting member may be tabular, or may be rod-shaped suspended between the outer tube and the inner tube.

In this manner, in the present invention, it is possible to prevent production of a vibration in the distal end of the inner tube which results in loss of a fixed interval between the outer peripheral face of the inner tube and the inner peripheral face of the outer tube at a base end and a distal end and thereby ensures a fixed interval between the first region forming the hole part and the inner peripheral surface of the outer tube. Consequently, stagnation points can be continuously formed in a stable manner and thereby formation and maintenance of a stable and continuous flame is possible.

A configuration is preferably adopted in which the supporting member is disposed further towards the distal end than the hole part positioned furthest towards the distal end, and has a size at least which covers the combustion space facing the first region.

In this manner, in the present invention, combustion gas ejected from the hole part positioned at the most distal end side towards the distal end side collides with the supporting member and is introduced into the combustion space on the second region side. Consequently, the flame at the stagnation point is also introduced into the combustion space on the second region side and ignition of the combustion gas in the combustion space is facilitated.

The present invention preferably adopts a configuration in which a plurality of hole parts is aligned and spaced in the first region and the supporting member has a size which covers the combustion space facing the first region on both sides in a direction of alignment sandwiching the stagnation point corresponding to the respective hole parts.

In this manner, in the present invention, the combustion gas ejected from each hole part to be introduced into the combustion space on the second region side. Consequently, the flame at the stagnation point is also introduced into the combustion space on the second region side and ignition of the combustion gas in the combustion space is further facilitated.

The invention adopts the following configuration as an actual configuration for achieving the above object.

A combustion heater according to the present invention includes an inner tube having a supply passage for combustion gas in an inner portion, and an outer tube disposed to provide a separated combustion space in an outer periphery of the inner tube. A hole part for ejecting the combustion gas is formed on a tube wall of the inner tube. This combustion heater includes a stagnation point for combustion gas ejected from the hole parts, a stagnation point for the formation of circulating flow and a circulating flow formation member which are disposed facing the hole parts along the axial direction in the combustion space.

In a combustion heater that has the above structure, formation and maintenance of a stable flame is facilitated (in other words, without causing cost increases) by igniting (lighting) combustion gas in the periphery of a stagnation point where the flow speed is approximately zero and which is formed on the stagnation point and the surface of the circulating flow formation member. Furthermore since a circulating flow is formed about the periphery of the stagnation point, stable combustion is realized. In the conventional example, when a gas flow amount increases, a discharge route for combustion gas cannot be maintained and there is the possibility that the stability of the flame will be reduced. However, the present invention forms and retains a stable flame on the stagnation point facing the hole part and the surface of the circulating flow formation member and can ensure a discharge route for combustion gas in a region in which the inner tube and the stagnation point and the circulating flow formation member are not opposed.

In the present invention, a configuration is preferably adopted in which the stagnation point and the circulating flow formation member are disposed on the central axis of the outer tube and a plurality of inner tubes is disposed about the central axis with the hole part facing the central axis.

In this manner, in the present invention, a stable stagnation point and flame for combustion gas are formed and maintained about the central axis of the outer tube and thus the temperature distribution can be controlled while heating the outer tube.

A configuration is preferably adopted in which the stagnation point and the circulating flow formation member have a supply passage for combustion gas in an inner section and a hole part is provided for forming a stagnation point and ejecting combustion gas towards the respective outer peripheral faces of the plurality of inner tubes that is disposed about the central axis.

In this manner, in addition to the stagnation point disposed in the center of the outer tube and the surface of the circulating flow formation member, a stable stagnation point for combustion gas and flame can also be formed and maintained on the face of the plurality of inner tubes that is disposed about the central axis.

A configuration is preferably adopted in which a plurality of stagnation points and the circulating flow formation members is provided at an interval in the combustion space, and is an inner tube respectively that forms the hole parts facing the outer peripheral surface of adjacent inner tubes.

In this manner, the plurality of inner tubes enables the formation and maintenance of a stable flame and stagnation point for combustion gas on the outer peripheral surface facing the hole parts of adjacent inner tubes.

In this manner, a configuration is preferably adopted in which a plurality of inner tubes is disposed with an interval about the central axis of the outer tube.

In this manner, the present invention enables the formation and maintenance of a stable flame and stagnation point for combustion gas about the central axis of the outer tube and thus the temperature distribution can be controlled while heating the outer tube.

In the present invention, a configuration is preferably adopted in which a second hole part for ejecting combustion gas to a position separated from the stagnation point in the tube is provided.

In this manner, in the present invention, propagation of a flame which is formed and maintained at the stagnation point is possible in the combustion gas ejected from the second hole part. Consequently, in the present invention, the pressure loss resulting from use of a porous body can be avoided. Furthermore since the introduced amount of heat can be increased without increasing the length of the inner tube and the outer tube, it is possible to prevent an increase in the size of the device resulting for example from increasing the length of the inner tube and outer tube. In the present invention, since pressure loss can be suppressed, application is possible to low-pressure city gas lines.

The second hole part preferably adopts a configuration in which the second hole part is disposed on both sides sandwiching the region facing the stagnation point and the circulation flow formation member and is disposed alternating with the hole part in a direction along the facing region.

In this manner, the present invention enables formation and maintenance of a flame and equal distribution of flame propagation.

The present invention preferably adopts a configuration in which a supporting member supports a distal end of the inner tube that are cantilever supported at a base end and the stagnation point and the circulating flow formation member between the outer tube, and maintains an interval between the inner peripheral surface of the outer tube and the outer peripheral surface of the inner tube and the stagnation point and the circulating flow formation member. The supporting member may be tabular, or may be rod-shaped suspended between the outer tube and the inner tube.

In this manner, in the present invention, it is possible to prevent production of a vibration in the distal end of the inner tube and the stagnation point and the circulating flow formation member which results in loss of a fixed interval between the inner tube and the stagnation point and the outer peripheral face of the circulating flow formation member and the inner peripheral face of the outer tube at a base end and a distal end and thereby ensures a fixed interval between the hole part and the stagnation point and the circulating flow formation member, and the inner peripheral surface of the outer tube. Consequently, stagnation points can be continuously formed in a stable manner and thereby formation and maintenance of a stable and continuous flame is possible.

A configuration is preferably adopted in which the supporting member is disposed further towards the distal end than the hole part positioned furthest towards the distal end, and at least has a size which covers the combustion space facing the hole part.

In this manner, in the present invention, combustion gas ejected from the hole part positioned at the most distal end side towards the distal end side collides with the supporting member and is introduced into the wide combustion space. Consequently, the flame at the stagnation point is also introduced into the combustion space and ignition of the combustion gas in the combustion space is facilitated.

In the present invention, a configuration is preferably adopted in which the supporting member is disposed more towards the distal end side than the most-distal hole part and has a size enabling covering of the entire combustion space.

Thus in the present invention, it is possible to avoid a situation in which the combustion gas accumulates in the distal end portion of the low-temperature outer tube and results in unburned situation and production of CO.

In the present invention, the supporting plate preferably adopts a configuration of freely displacing in an axial direction relative to the outer tube.

In this manner, in the present invention, even when there is a large difference in the amount of thermal expansion particularly in an axial direction due to a temperature difference between the outer tube and the inner tube, since the supporting plate displaces relative to the outer tube, deformation or the like of the supporting plate does not occur, and an interval between the outer peripheral face of the inner tube and the inner peripheral face of the outer tube can be maintained.

Furthermore the present invention preferably adopts a configuration in which the supply passage in the inner tube is closed at the distal end.

In this manner, the present invention provides a small low-cost combustion heater that supplies combustion gas from a base end and enables discharge of exhaust gases.

Effects of the Invention

According to the present invention, heating efficiency of a combustion heater can be improved by forming a stable flame without causing cost increases.

BEST MODES FOR CARRYING OUT THE INVENTION

The aspects of the embodiments of a combustion heater according to the present invention will be described below making reference to FIG. 1 to FIG. 13. Since each figure used in the description below depicts each member with a size enabling recognition thereof, suitable modification may be made to the dimensions of each member.

(First Embodiment)

Figure 1B:
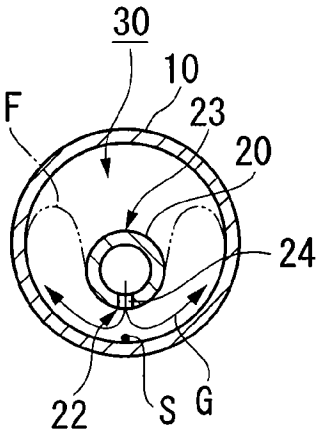
FIG. 1B is a side sectional view of a combustion heater according to the first embodiment.
Figure 1A:
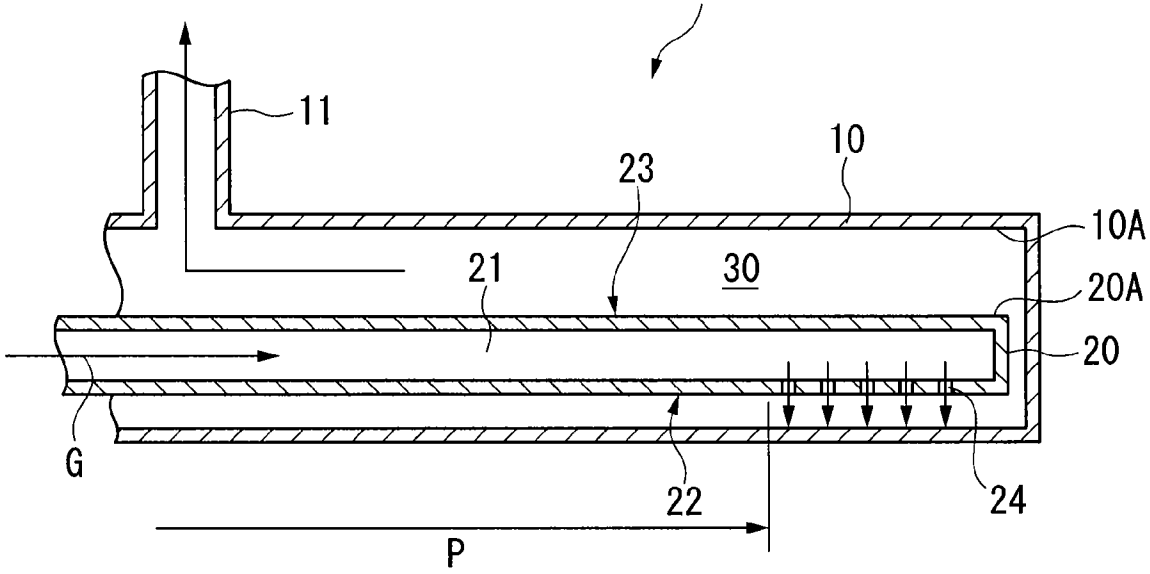
FIG. 1A is a front sectional view of a combustion heater according to a first embodiment.

FIG. 1A is a front sectional view of a combustion heater 1 according to a first embodiment and FIG. 1B is a side sectional view.

The combustion heater 1 schematically includes an outer tube 10 acting as a radiation tube made from a heat-resistant metal and closed at a distal end, and a heat-resistant metal inner tube 20 cantilever-supported by a support means (not shown) at a base end (left side of FIG. 1A), disposed in an inner portion of the outer tube 10 and having a supply passage 21 for combustion gas G in an inner portion.

A combustion gas G includes a premixed gas of fuel and air or a premixed gas of fuel and an oxygen-containing gas. The fuel includes methane, propane or the like. Furthermore a liquid fuel may be used by providing a position for prevaporization.

The outer tube 10 has a round cylindrical shape with a bottom closed at a distal end and is connected at the base end with a discharge tube 11 which discharges combusted gas.

The inner tube 20 has a round cylindrical shape with a bottom closed at a distal end in the same manner as the outer tube 10 and is connected at the base end with a premixed gas supply mechanism (not shown) for supplying the combustion gas G above. For example, the whole premixed gas may be supplied with an air excess ratio of 1.0-1.6.

The inner tube 20 is disposed eccentrically on an inner side of the outer tube 10 at the distal end to thereby form a combustion space 30 between the outer peripheral face 20A and the inner peripheral face 10A of the outer tube 10.

The outer peripheral surface 20A of the inner tube 20 has a first region 22 at which a distance to the inner peripheral surface 10A of the outer tube 10 is shortest, and a second region 23 at which the distance is longer than the first region 22. More specifically, on the outer peripheral surface 20A, the first region (bus line) 22 which has the shortest distance to the inner peripheral surface of 10A of the outer tube 10 is formed in an axial direction in a portion positioned in an eccentric orientation in the inner tube 20 (in FIG. 1, refer to lower section of FIG. 1B), and in other regions, the second region 23 is formed which has a longer distance to the inner peripheral surface 10A than the first region 22.

In the first region 22, a plurality of hole parts 24 (five in this example) spaced at an interval along the first region 22 and pierce the tube wall along a diameter direction at a position which is the distal end of the inner tube 20. An ignition apparatus (not shown) is provided in proximity to a position facing the hole parts 24 of the inner tube 20.

The outer peripheral surface 20A disposed further towards the base end (left side of FIG. 1A) than the region forming the hole parts 24 is a preheating region P for preheating the combustion gas G of the supply passage 21 using combusted gases (flame).

Next, the combustion operation in the combustion heater 1 will be described.

Combustion gas G supplied from the premixed gas supply mechanism to the supply passage 21 of the inner tube 20 is ejected from the hole part 24 towards the inner peripheral surface 10A of the outer tube 10.

Since the hole part 24 is formed in the first region 22 which has the shortest distance to the inner peripheral surface 10A of the outer tube 10, combustion gas G which is ejected from the hole part 24 collides with the opposed inner peripheral surface 10A of the outer tube 10, forms a stagnation point S on the inner peripheral surface 10A with respect to each hole part 24, and displays a branching distribution along the inner peripheral surface 10A at each stagnation point S.

An ignition apparatus ignites the combustion gas G in proximity to a stagnation point S to thereby form a flame. The combustion gas G branching at a stagnation point S flows from the proximity to the first region 22 which has a small sectional area into the combustion space which is on the opposite side to the first region 22 and has a large sectional area. As shown in FIG. 1B, a flame F is formed on both sides of the combustion space 30 about the inner tube 20.

Since the flow speed of the gas at the stagnation point S is zero at this time and since the circulating flow formed in proximity to the jet towards the stagnation point S, a resulting flame is stably retained.

The combustion gas flows through the combustion space 30 and is discharged from a discharge tube 11. However heat exchange with the combustion gas (uncombusted gas) G occurs with the tube wall of the inner tube 20 in the preheating region P of the inner tube 20 in halfway from the combustion space 30 to the discharge tube 11.

In this manner, the combustion gas G in the supply passage 21 is ejected from the hole part 24 in a high-temperature pre-heated state and thereby increases the stability of the flame F and therefore even when ejected into the small confined combustion space 30, uncombusted components are not produced and stable combustion is enabled.

In the present embodiment, as described above, a stagnation point S for combustion gas G is formed on an inner peripheral surface 10A of the outer tube 10, and combustion gas G is ejected with ejection characteristics such that a circulating flow is formed on the periphery of the stagnation point S. As a result, since the combustion gas is expelled from the hole part 24 formed in the tube wall of the inner tube 20 and a flame F is maintained at the stagnation point, a stable flame F can be easily formed even when varying a flow amount without incurring the cost unlike in the case of increases associated with the provision of a porous tube.

In addition, in the present embodiment, the combustion amount can be increased by merely increasing the number of hole parts 24. Thus a simple structure with few components enables suppression of manufacturing costs for the combustion heater 1. Moreover, application is possible to low-pressure city gas lines since there is no necessity to greatly increase the supply pressure of the combustion gas G such as when using a porous tube. Furthermore, in the present embodiment, a simple structure is formed by disposing the inner tube 20 eccentrically with respect to the outer tube 10 to form a first region 22 which as a short distance between the outer peripheral surface 20A of the inner tube 20 and the inner peripheral surface 10A of the outer tube 10. Therefore a stable flame F can be formed and maintained in a simple manner and at a low cost.

When a porous tube is used and the supply pressure of gas is increased, there is the possibility that the flame will extend to the outer tube and will not be maintained, and that the discharge route for combusted gas will not be maintained. However, in the present embodiment, a sufficient discharge route is maintained in the combustion space 30 facing the region (second region) opposite the first region 22 and in a space which is between adjacent hole parts and ejection does not occur.

In the present embodiment, since a stagnation point S is formed on an inner peripheral face 10A of the outer tube 10 and the flame F is maintained along the inner peripheral surface 10A, extraction of heat is not impeded such as when a tube-shaped flame is separated from the outer tube 10, and heating efficiency by the outer tube 10 is improved.

(Second Embodiment)

Next, a second embodiment of the combustion heater 1 will be described making reference to FIG. 2.

In the figure, those components which are the same as the components of the first embodiment shown in FIG. 1 are denoted by the same reference numerals and description thereof will not be repeated.

The point of difference of the second embodiment from the first embodiment resides in the fact that a second hole part for reducing gas pressure loss is provided separately to the hole part 24.

Figure 2B:
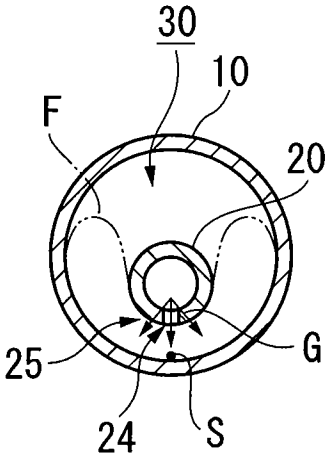
FIG. 2B is side sectional view of a combustion heater including an inner tube.
Figure 2A:
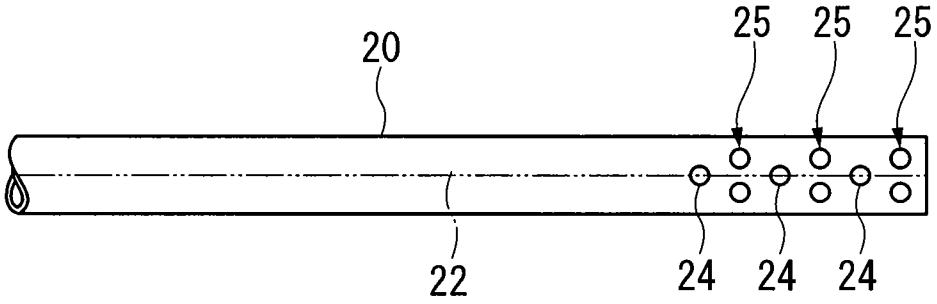
FIG. 2A is a plan view of the inner tube seen from a first region.

FIG. 2A is a plan view of the inner tube 20 seen from the first region 22 and FIG. 2B is side sectional view of the combustion heater 1 including the inner tube 20.

As shown in FIG. 2A, in the tube wall of the inner tube 20, a hole part 24 is provided in the first region 22 and, in addition, a second hole part 25 is provided alternating with the hole part 24 along the first region 22 on both sides about the first region 22.

As shown in FIG. 2B, combustion gas G is ejected from the second hole part 25 towards a position separated from the stagnation point S.

The second hole part 25 is provided at a position of stable propagation of a flame S formed at the stagnation point S in combustion gas G ejected from the second hole part 25.

In other respects, the configuration is the same as the first embodiment.

In the combustion heater 1 having the above configuration, a flame F which is formed and maintained at a stagnation point S can be propagated in combustion gas G ejected from the second hole part 25 to thereby facilitate combustion of gas under an increased flow amount. As a result, in the present embodiment, pressure loss caused for example by use of a porous body can be avoided. Furthermore the introduced amount of heat can be increased without increasing the length of the inner tube 20 and the outer tube 10 to increase the flow amount. As a result, it is possible to prevent an increase in the size of the device resulting for example from increasing the length of the inner tube 20 and outer tube 10. Moreover, in the present invention, since pressure loss can be suppressed, application is possible to low-pressure city gas lines.

Further, in the present embodiment, since the hole part 24 and the second hole part 25 are disposed alternately along the first region 22, or the second hole part 25 is disposed on both sides sandwiching the first region 22, formation and maintenance of a flame F and flame propagation are produced in a stable state with an substantially equal distribution.

(Third Embodiment)

Next, a third embodiment of the combustion heater 1 will be described making reference to FIG. 3.

In the figure, those components which are the same as the components of the first embodiment shown in FIG. 1 are denoted by the same reference numerals and description thereof will not be repeated.

The point of difference of the third embodiment from the first embodiment resides in the provision of a supporting plate on the distal end of the inner tube 20.

Figure 3B:
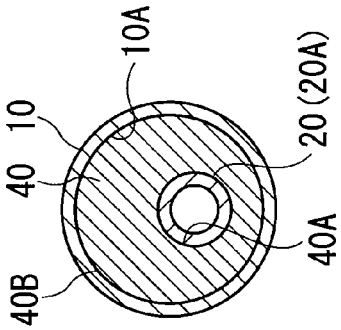
FIG. 3B is a side sectional view of the combustion heater according to the third embodiment.
Figure 3A:
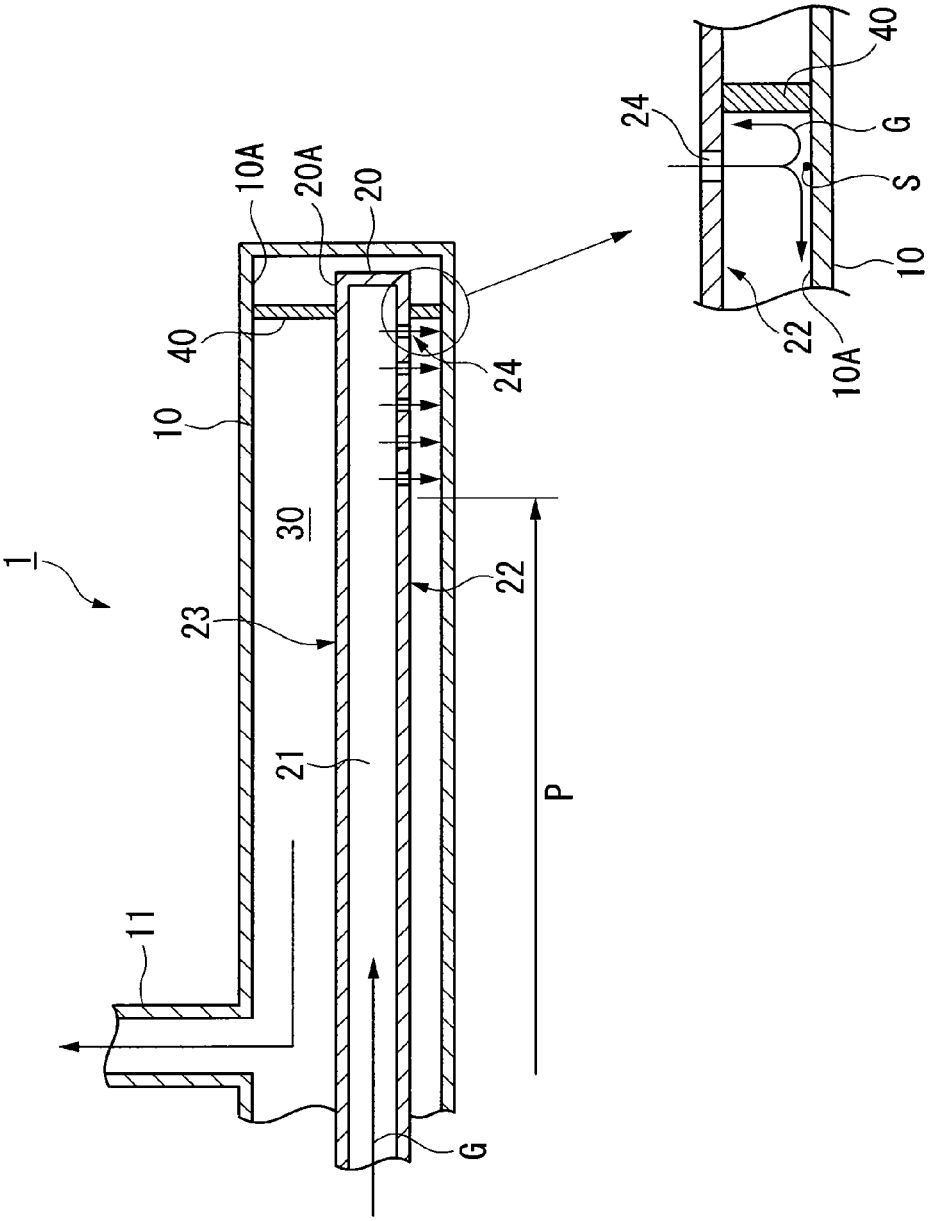
FIG. 3A is a front sectional view of a combustion heater according to a third embodiment.

As shown in FIG. 3A, a supporting plate (supporting member) 40 formed from a heat-resistant metal or the like in a direction which is orthogonal to the axial direction is provided further towards a distal end than the hole part 24 of the inner tube 20. As shown in FIG. 3B, the supporting plate 40 is engaged and fixed to the outer peripheral surface 20A of the inner tube 20 by a through hole 40A and is supported to displace freely in an axial direction on the inner peripheral face 10A of the outer tube 10 on an outer peripheral surface 40B.

That is to say, the supporting plate 40 is integrally formed with the inner tube 20 to have a size which enables closure of the whole combustion space 30 and is provided to freely displace in an axial direction with reference to the outer tube 10.

In the combustion heater 1 having the above configuration, since the distal end of the inner tube 20 which is cantilever supported on a base end is supported by the supporting plate 40, a interval between the outer peripheral surface 20A of the inner tube 20 (that is to say, the first region 22) and the inner peripheral surface 10A of the outer tube 10 can be constant. Furthermore even when the high-temperature inner tube 20 undergoes thermal expansion by reason of a temperature difference between the outer tube 10 and the inner tube 20, deformation or bending can be prevented since the supporting plate 40 which is integrally formed with the inner tube 20 can displace in an axial direction relative to the inner peripheral surface 10A of the outer tube 10.

Combustion gas G which is ejected from the hole part 24 which is positioned furthest towards a distal end collides with the inner peripheral surface 10A of the opposed outer tube 10, forms a stagnation point S on the inner peripheral surface 10A at each hole part 24, and branches along the inner peripheral surface 10A at the stagnation point S. However since the combustion space 30 which is opposed to the first region 22 is closed by the supporting plate 40, combustion gas G branching towards the supporting plate 40 collides with the supporting plate 40 and then is introduced into the combustion space 30 facing the opposite side (second region 23) to the first region 22. Consequently, ignition of the peripheral combustion gas G is facilitated by a flame which is retained at the stagnation point S.

In the present embodiment, since the combustion space 30 is partitioned by the supporting plate 40, it is possible to avoid a situation in which the combustion gas G accumulates in an uncombusted state in the distal end portion of the outer tube 10 which has a relatively low temperature and results in production of CO.

In the above embodiment, although the supporting member is configured as a tabular supporting plate 40, the invention is not limited in this respect, and for example, it may employ a supporting member which includes a ring member supported to freely displace in an axial direction on the inner peripheral surface 10A of the outer tube 10 and a rod member which connects the ring member and the inner tube 20.

(Fourth Embodiment)

Next, a fourth embodiment which is a modification of the third embodiment above will be described making reference to FIG. 4.

In the figure, those components which are the same as the components of the third embodiment shown in FIG. 3 are denoted by the same reference numerals and description thereof will not be repeated.

Figure 4:
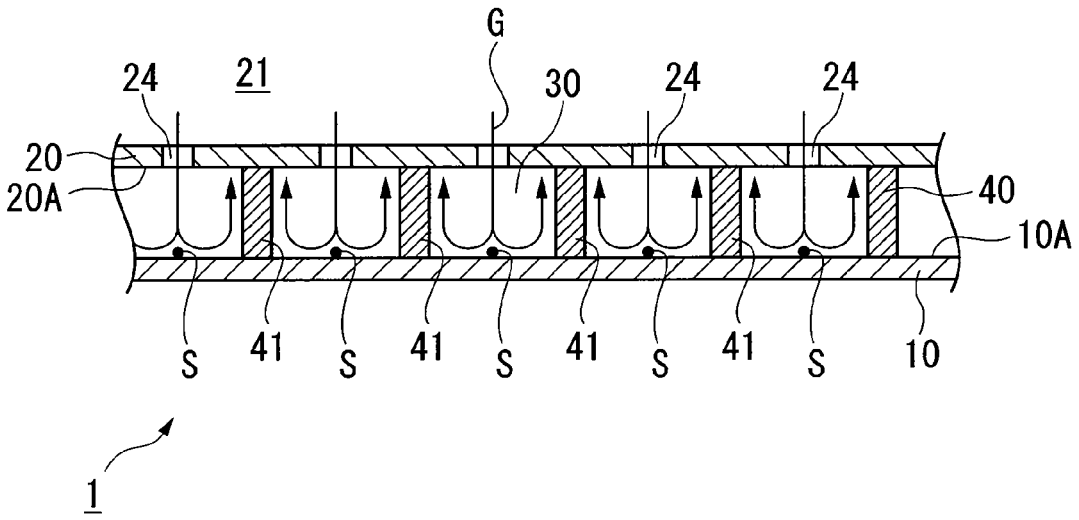
FIG. 4 is a detailed view of the principal components of a combustion heater according to a fourth embodiment.

As shown in FIG. 4, in the present embodiment, a supporting plate 41 is respectively provided on the outer peripheral surface 20A of the outer tube 20 on both sides in the direction of alignment of the hole parts 24 to sandwich the stagnation point S which corresponds to the hole part 24, and is further towards the base end than the supporting plate 40. The supporting plate 41 has a size which closes the combustion space 30 facing the first region 22. More specifically, each supporting plate 41 does not close the whole of the combustion space 30 like the supporting plate 40, but covers only the combustion space 30 in proximity to the first region 22 so that combustion gas G ejected from the hole part 24 can flow into the combustion space 30 on the opposite side, and be discharged from the discharge tube 11. Furthermore each supporting plate 41 protrudes from the tube wall of the inner tube 20 towards the outer tube 10 only on the periphery of the first region 22 so that the position of the inner tube 20 with respect to the outer tube 10 is maintained and is formed in a fan shape for example supported on the inner peripheral surface 10A.

In the combustion heater 1 having the above configuration, combustion gas G ejected from each hole part 24 collides with the supporting plate 41 and then is introduced into the combustion space 30 facing the opposite side to the first region 22 (second region 23). Consequently, more effective ignition of the peripheral combustion gas G is facilitated by a flame which is retained at the stagnation point S.

(Fifth Embodiment)

Next, a fifth embodiment of the combustion heater 1 will be described making reference to FIG. 5.

Figure 5:
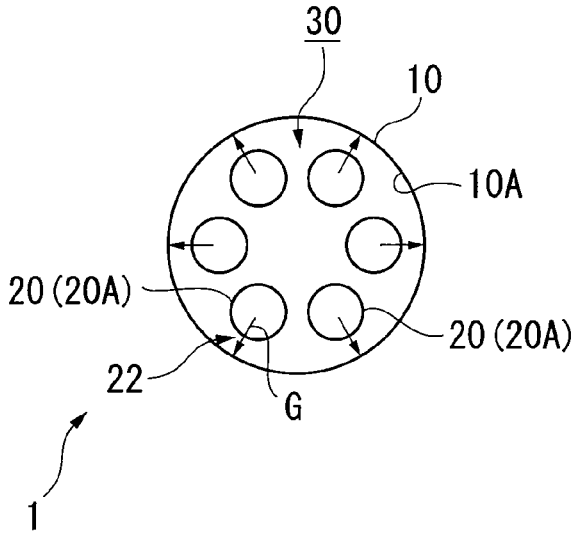
FIG. 5 is a schematic view of an outer tube and inner tube according to a fifth embodiment.

FIG. 5 is a schematic view of an outer tube 10 and inner tube 20.

As shown in the figure, an inner tube 20 in the combustion heater 1 according to the present embodiment is provided in the combustion space 30 in the outer tube 10 at an interval in a peripheral direction about the central axis of the outer tube 10. The plurality of inner tubes 20 (in FIG. 5, six are provided at an interval of 60°) is respectively disposed in an eccentric orientation to the outer tube 10.

Furthermore, in each inner tube 20, a plurality of hole parts 24 (not shown in FIG. 5) is formed at an interval in an axial direction and is positioned in the first region 22 at which the distance between the outer peripheral surface 20A and the inner peripheral surface 10A of the outer tube 10 is shortest.

In the combustion heater 1 having the above configuration, combustion gas G is respectively ejected from (the hole parts of) the plurality of inner tubes 20 and a stagnation point is formed on the inner peripheral surface 10A of the outer tube 10 to thereby form a stable plurality of flames about the axis along the inner peripheral surface of the outer tube 10 by ignition of the combustion gas G.

Therefore in addition to obtaining the same operation and effect as the first embodiment, the present embodiment enables heating of the outer tube 10 to a higher temperature.

The configuration and assembly of each constituent member described in the examples above are merely exemplary and various modifications are possible resulting from design requirements or the like within a scope which does not depart from the present invention.

For example, in the second embodiment, although a configuration was described in which a second hole part 25 was provided in addition to the hole part 24, the invention is not limited in this respect, and a configuration of the inner tube 20 is possible with respect to the third to the fifth embodiments in which a second hole part is provided in addition to the hole part 24.

In the embodiments above, a configuration was adopted in which a first region 22 having the shortest distance between the outer peripheral surface 20A and the inner peripheral surface 10A of the outer tube 10 was formed by disposing each inner tube 20 in an eccentric orientation to the outer tube 10. However the invention is not limited in this regard and a concentric orientation is also possible. For example as shown in FIG. 6, a configuration may be provided in which the inner tube 20 and the outer tube 10 may be disposed concentrically, and a ridge 42 is provided protruding into the combustion space 30 on the inner peripheral surface 10A of the outer tube 10, and the hole part 24 is provided facing the ridge 42 in the first region 22 in which the distance to the outer peripheral surface 20A is shortest, or as shown in FIG. 7, the inner tube 20 and the outer tube 10 may be provided concentrically, and a ridge 43 may be provided to protrude into the combustion space 30 on the outer peripheral surface 20A of the inner tube 20 and form the first region 22 in which the distance to the inner peripheral surface 10A is shortest, and the hole part 24 may be formed on the ridge 42.

Figure 6:
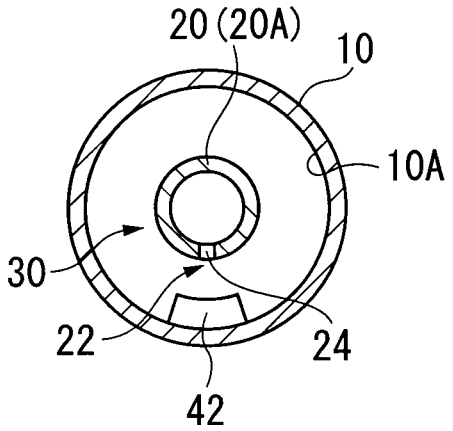
FIG. 6 is a sectional view of a concentrically-disposed outer tube and inner tube.
Figure 7:
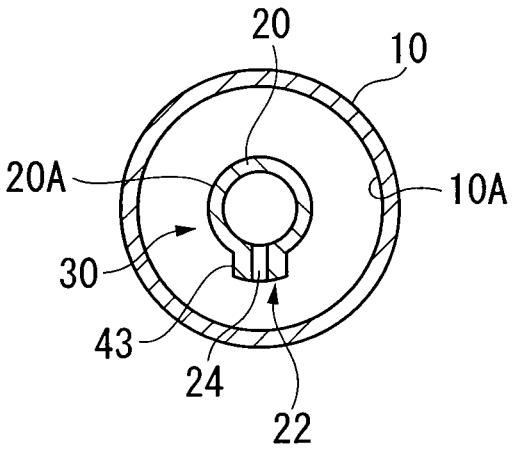
FIG. 7 is a sectional view of a concentrically-disposed outer tube and inner tube.
Figure 8:
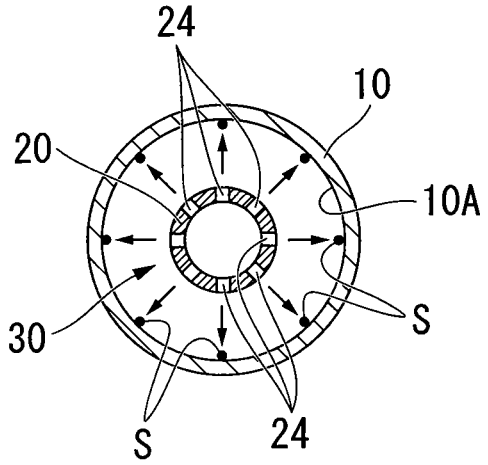
FIG. 8 is a sectional view of another aspect of a concentrically-disposed outer tube and inner tube

As shown in FIG. 6 and FIG. 7, when the inner tube 20 and the outer tube 10 are disposed concentrically, it is not always necessary to form the first region in which the distance between the outer peripheral surface 20A of the inner tube 20 and the inner peripheral surface 10A of the outer tube 10 is shortest. For example, as shown in FIG. 8, the invention may be applied to a configuration in which the outer peripheral surface 20A of the inner tube 20 and the inner peripheral surface 10A of the outer tube 10 are disposed at equal intervals. In this case, a stagnation point S is formed at a specific position on the inner peripheral surface 10A of the outer tube 10 facing the hole part 24 of the inner tube 20. Moreover, the formation of a circulating flow in the periphery of this stagnation point S enables the maintenance of a stable flame formed by the circulating flow formed in the periphery of the ejection towards the stagnation point S and therefore enables the same operation and effect as the above embodiments.

A further embodiment of the present invention will be described below. The following embodiment includes a stagnation point and a circulating flow formation member to form a stagnation point and a circulating flow in the combustion gas in the combustion heater.

(Sixth Embodiment)

Figure 9B:
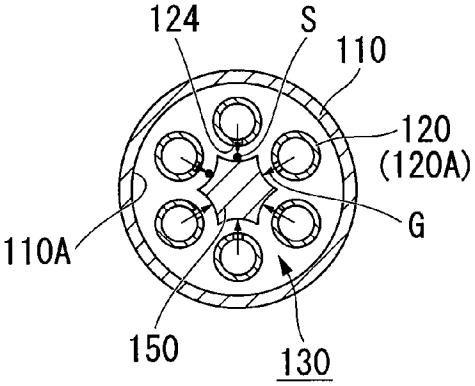
FIG. 9B is a side sectional view of a combustion heater according to the sixth embodiment.
Figure 9C:
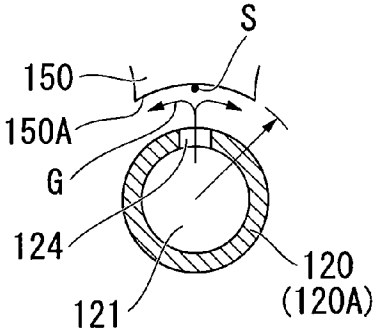
FIG. 9C is a side sectional view of a combustion heater according to the sixth embodiment.
Figure 9A:
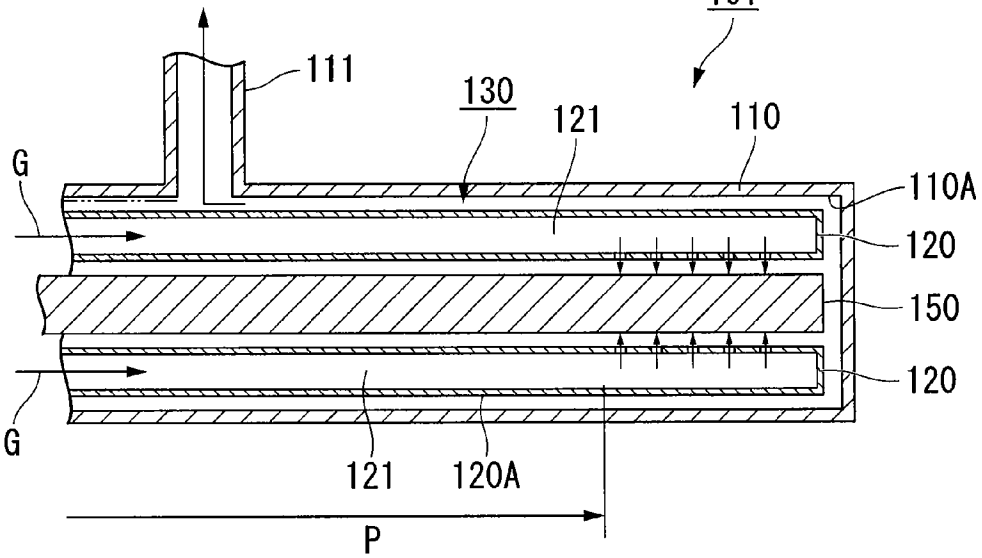
FIG. 9A is a front sectional view of a combustion heater according to a sixth embodiment.

FIG. 9A is a front plan view of combustion heater according to the first embodiment and FIG. 9B is side sectional view.

The combustion heater 101 schematically includes an outer tube 110 acting as a radiation tube made from a heat-resistant metal and closed at a distal end, and a bluff body 150 (stagnation point and circular flow formation member) and a plurality of heat-resistant metal inner tubes 120 that are cantilever-supported by a support means (not shown) at a base end (left side of FIG. 9A), disposed in a combustion space 130 of an inner portion of the outer tube 110 and having a supply passage 21 for combustion gas G in an inner portion.

A combustion gas G includes a premixed gas of fuel and air or a premixed gas of fuel and an oxygen-containing gas. The fuel includes methane, propane or the like. Furthermore a liquid fuel may be used by providing a position for prevaporization.

The outer tube 110 has a round cylindrical shape with a bottom closed at a distal end and is connected at the base end with a discharge tube 111 which discharges combusted gas.

The inner tube 120 has a round cylindrical shape with a bottom closed at a distal end in the same manner as the outer tube 110 and is connected at the base end with a premixed gas supply mechanism (not shown) for supplying the combustion gas G above. For example, the whole premixed gas may be supplied with an air excess ratio of 1.0-1.6.

As shown in FIG. 9B, a plurality of inner tubes 20 is disposed at an interval about the central axis of the outer tube 110 (in this example six are disposed at an interval of 60°).

Each inner tube 120 has a plurality of hole parts 124 (five in this example) which are spaced at an interval in an axial direction at a position facing the bluff body 150 at a distal end and toward the central axis of the outer tube 110 to pierce the tube wall along a diameter direction. An ignition apparatus (not shown) is provided in proximity to a position facing the hole parts 124 of the outer tube 110.

The outer peripheral surface 120A disposed further towards the base end (left side of FIG. 9A) than the region forming the hole parts 124 is a preheating region P for preheating the combustion gas G of the supply passage 121 by using combusted gases (flame).

The axial line of the bluff body 150 is aligned with the central axis of the outer tube 110 and the circumference thereof is surrounded by inner tubes 120. A concave curve 150A formed about the axis of the inner tube 120 is formed in an axial direction at a position facing each inner tube 120 (hole part 124).

Next, the combustion operation in the combustion heater 101 will be described.

Combustion gas G supplied from the premixed gas supply mechanism to the supply passage 121 of the inner tube 120 is ejected from the respective hole parts 124 towards the concave curve 150A of the bluff body 150.

Combustion gas G which is ejected from the hole parts 124 collides with the concave curve 150A of the bluff body 150, forms a stagnation point S on the concave curve 150A corresponding to each hole part 24, and is branced along the concave curve 150A at each stagnation point S.

An ignition apparatus ignites the combustion gas G in proximity to the stagnation points S to thereby form and maintain a flame at the stagnation point S. Since the flow speed at the stagnation point S at this time is approximately zero, the flame formed by circular flow in the periphery of the jet towards the stagnation point S is stably maintained at the stagnation point S.

The combustion gas G which has branched at the stagnation point S flows from the proximity of the bluff body 150 which has a high gas pressure into the combustion space 130 which is the inner peripheral surface 110A side of the outer tube 110 which is the opposite side to the bluff body 150 with respect to the inner tube 120.

The combustion gas flows through the combustion space 130 and is discharged from a discharge tube 111. However heat exchange with the combustion gas (uncombusted gas) G occurs with the tube wall of the inner tube 120 in the preheating region P of the inner tube 120 in halfway from the combustion space 130 to the discharge tube 111.

In this manner, the combustion gas G in the supply passage 121 is ejected from the hole part 124 in a high-temperature pre-heated state and thereby increases the stability of the flame F. Thus even when the gas G is ejected into the small confined combustion space 130, uncombusted components are not produced and stable combustion is enabled.

In the present embodiment as described above, since combustion gas G is ejected from the hole part 124 formed on the tube wall of the inner tube 120 toward the concave curve 150A of the bluff body 150 and the flame F is retained at the stagnation point S, cost increases caused by provision of a porous tube can be avoided and formation of a stable flame F can be facilitated even when a flow amount is varied. In addition, in the present embodiment, merely increasing the number of holes 124 enables an increase in the combustion amount. Thus manufacturing costs for the combustion heater 101 can be suppressed by use of few components and a simple structure. Moreover, there is no need to considerably increase the supply pressure of the combustion gas G such as when using a porous tube, and thus application to low-pressure city gas lines is sufficiently enabled. Furthermore in the present embodiment, a flame can be formed and maintained using a respective plurality of inner tubes 120 disposed about the central axis of the outer tube 110 and thus a uniform heating process can be realized without causing a temperature distribution in a peripheral direction of the outer tube 110 which is the radiation tube.

When the supply pressure is increased due to the use of a porous tube, there is the possibility that the flame will extend to the outer tube and cannot be retained, and that the discharge route for combusted gas will not be maintained. However in the present embodiment, a sufficient discharge route is maintained in the combustion space 130 in proximity to the inner peripheral surface 110A of the outer tube 110 and in the space which ejection is not present between adjacent holes.

In particular, in the present embodiment, since the passage for combustion gas G which branched at the stagnation point S is along the outer peripheral surface 120A of the inner tube 120, smooth discharge of gas is enabled into the combustion space 130 which is proximity to the inner peripheral surface 110A of the outer tube 110.

Meanwhile, in the present embodiment, a configuration is used in which an axially-orientated bluff body acts as a stagnation point and a circulating flow formation member. However the present invention is not limited in this regard and it is possible to use a tube body (a round tube or for example, a hexagonal tube).

(Seventh Embodiment)

Next, a seventh embodiment of the combustion heater 101 will be described making reference to FIG. 10.

In the figure, those components which are the same as the components of the first embodiment shown in FIG. 6 are denoted by the same reference numerals and description thereof will not be repeated.

The point of difference between the seventh embodiment and the first embodiment resides in the fact that a circular tube which is the same as the inner tube 20 is disposed on the central axis of the outer tube 110.

Figure 10A:
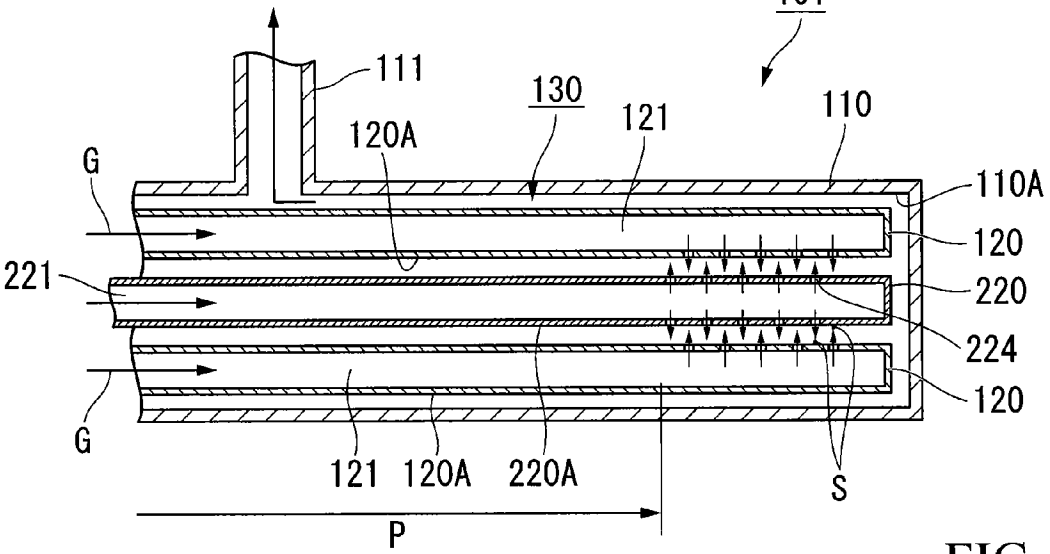
FIG. 10A is a front sectional view of a combustion heater according to a seventh embodiment.
Figure 10B:
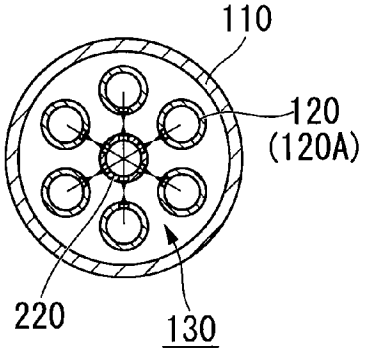
FIG. 10B is a side sectional view of a combustion heater according to the seventh embodiment.
Figure 10C:
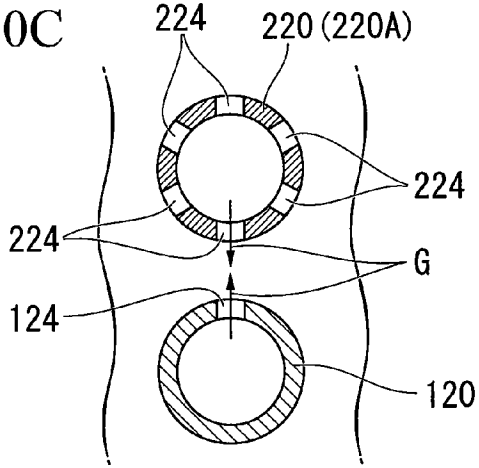
FIG. 10C is an enlarged view of the principal components of a combustion heater according to the seventh embodiment.

In other words, as shown by the partial enlarged view in FIG. 10C, in the present embodiment, an inner tube (stagnation point and circulating flow formation member) 220 is axially aligned with central axis of the outer tube 110 and disposed with an interval with respect to the inner tube 120. The inner tube 220 is a round cylinder and is provided with a bottom with a distal end thereof is closed. A premixed gas supply mechanism (not shown) for supplying combustion gas G to the supply passage 221 in an inner portion is connected to the base end side.

Figure 10D:
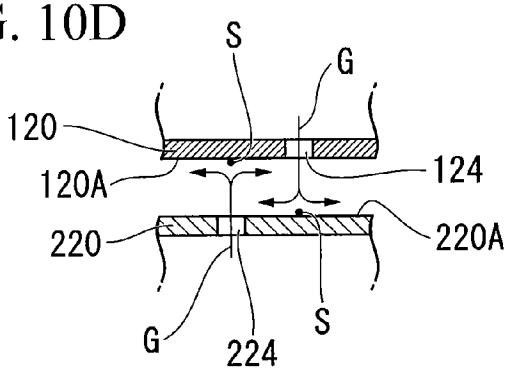
FIG. 10D is an enlarged view of the principal components of a combustion heater according to the seventh embodiment.

The inner tube 220 forms hole parts 224 for ejecting combustion gas G respectively at a position facing each inner tube 120 disposed on a circumference thereof. As shown in FIG. 10D, the axial orientation is such that the hole parts 224 are formed at a position facing the outer peripheral surface 120A and do not face the hole parts 124 for each inner tube 120. In other words, the hole parts 124 of the inner tube 120 also face the outer peripheral surface 220A and do not face the hole parts 224 of the inner tube 220.

In other respects, the configuration is the same as the first embodiment.

In the combustion heater 101 having the above configuration, combustion gas G supplied from the premixed gas supply mechanism to the supply passage 121 of the inner tube 120 is ejected from the respective hole parts 124 towards the outer peripheral surface 220A of the inner tube 220. A stagnation point S for combustion gas G is formed on the outer peripheral surface 220A. Combustion gas G branches at the stagnation point S and flows along the outer peripheral surface 220A.

On the other hand, combustion gas G supplied to the supply passage 221 of the inner tube 220 is ejected from the respective hole parts 224 towards the outer peripheral surface 120A of the inner tube 120. A stagnation point S for combustion gas G is formed on the outer peripheral surface 120A, and combustion gas G branches at the stagnation point S and flows along the outer peripheral surface 120A. In other words, in the present embodiment, the inner tube 120 also operates as a stagnation point and circulating flow formation member in addition to the inner tube 220.

Ignition of the combustion gas G by an ignition apparatus in proximity to the stagnation point S enables formation and retention of a flame at the stagnation point S. Since the flow speed of the gas at the stagnation point S at this time is zero, a resulting flame is stably retained at the stagnation point S.

The combustion gas G branching at the stagnation point S flows into the combustion space 130 on the inner peripheral surface 110A side of the outer tube 110 which has a relatively low gas pressure. The combusted gas is discharged from the discharge tube 111.

In this way, in the above embodiment, in addition to obtaining the same operation and effect as the first embodiment, since combustion gas G is also ejected from the inner tube 220, more effective heating is enabled. Furthermore since a stagnation point S is also formed on the outer peripheral surface 120A of the inner tube 120 which is disposed on a circumference thereof and thereby forms and retains a flame, a stable flame can be formed and retained in a broader scope.

The hole part 124 of the inner tube 120 and the hole part 224 of the inner tube 220 may be provided at mutually opposed positions. However provision is preferred at a mutually facing position on the outer peripheral surface 220A, 120A in order to form a more stable stagnation point S.

(Eighth Embodiment)

Next, an eighth embodiment of the combustion heater 101 will be described making reference to FIG. 11.

In addition, in the figure, those components which are the same as the components of the first embodiment shown in FIG. 9 are denoted by the same reference numerals and description thereof will not be repeated.

Figure 11B:
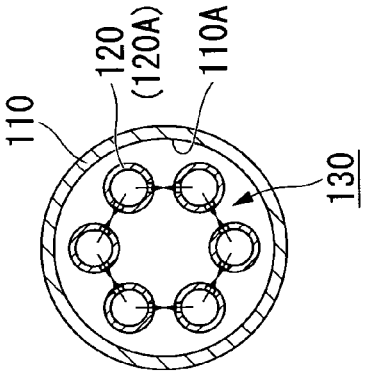
FIG. 11B is a side sectional view of a combustion heater according to the eighth embodiment.

As shown in FIG. 11B, in the present embodiment, a plurality of inner tubes 120 is mutually disposed at an interval in a peripheral direction about the central axis (in the figure, six are provided at an interval of 60°) without providing an inner tube on the central axis of the outer tube 110.

Figure 11C:
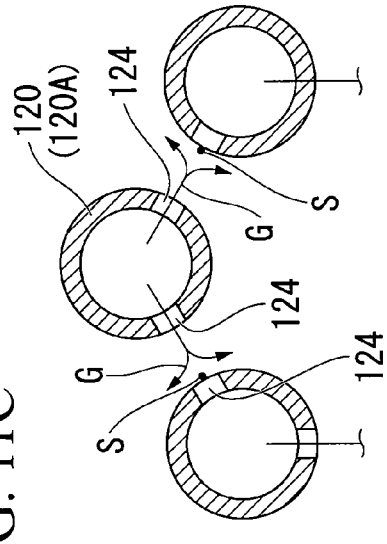
FIG. 11C is an enlarged view of the principal components of a combustion heater according to the eighth embodiment.

As shown by the partial enlarged view in FIG. 11C, each inner tube 120 includes respective hole parts 124 that eject combustion gas G to a position facing the adjacent inner tube 120.

In the same manner as the seventh embodiment, the axial position of the hole parts 124 is preferably positioned alternately for adjacent inner tubes 120 so that ejected combustion gas G collides with an outer peripheral surface 120A of the adjacent inner tube 120 as shown by the partial enlarged view in FIG. 10D.

In the combustion heater 101 having the above configuration, in addition to obtaining the same operation and effect as the seventh embodiment, since a stagnation point S and a flame are formed at a more proximate position to the outer tube 110 that acts as a radiation tube, heat extraction by the outer tube 110 is facilitated and heating efficiency can be improved.

(Ninth Embodiment)

Next, a ninth embodiment of the combustion heater 101 will be described making reference to FIG. 12.

In the figure, those components which are the same as the components of the sixth embodiment shown in FIG. 9 are denoted by the same reference numerals and description thereof will not be repeated.

The point of difference of the ninth embodiment from the sixth embodiment resides in the fact that a supporting plate is provided on a distal end side of the inner tube 120 and the bluff body 150.

Figure 12A:
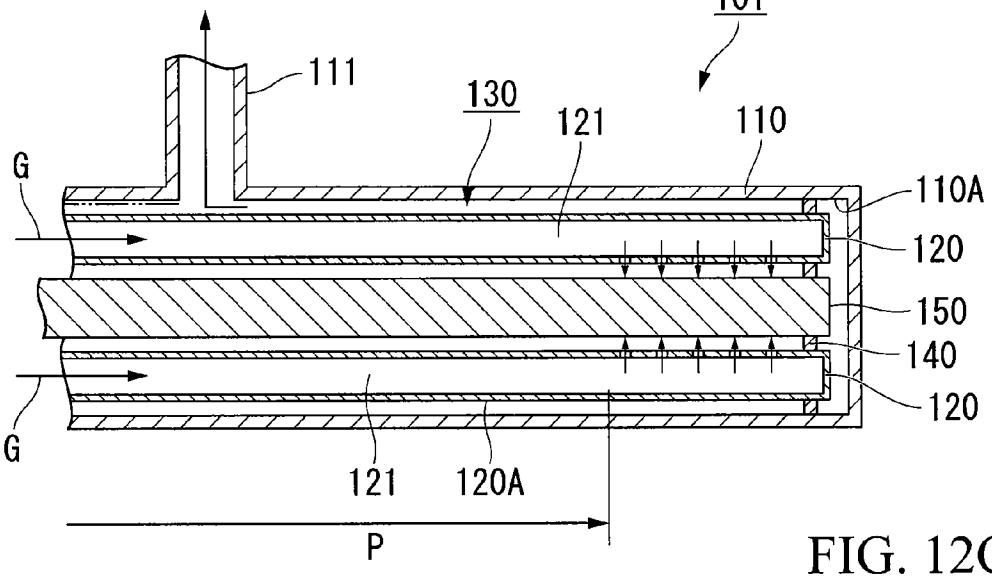
FIG. 12A is a front sectional view of a combustion heater according to a ninth embodiment.
Figure 12B:
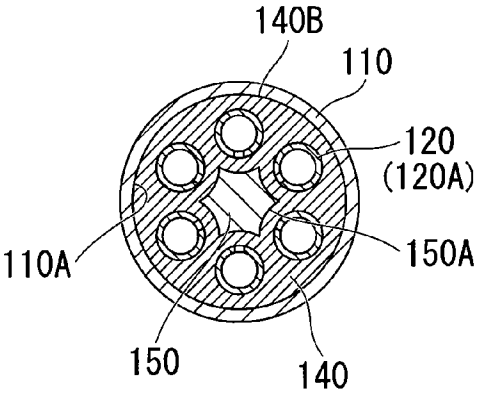
FIG. 12B is a side sectional view of a combustion heater according to the ninth embodiment.

As shown in FIG. 12A, a supporting plate (supporting member) 140 formed from a heat-resistant metal or the like is provided further towards a distal end than the hole part 124 of the inner tube 120 along a direction which is orthogonal to the axial direction. As shown in FIG. 12B, the supporting plate 140 is engaged and fixed to the outer peripheral surface 120A of the inner tube 120 and the outer peripheral surface 150A of the bluff body 150 and is supported to displace freely in an axial direction on the inner peripheral face 110A of the outer tube 110 by an outer peripheral surface 140B.

That is to say, the supporting plate 140 is integrally formed with the inner tube 120 and the bluff body 150 to have a size which enables closure of the whole combustion space 130 and is provided to freely displace in an axial direction with reference to the outer tube 110.

In the combustion heater 101 having the above configuration, since distal end of the inner tube 120 and the bluff body 150 which are cantilever supported on a base end is supported by the supporting plate 140, a fixed interval can be maintained between the outer peripheral surface 120A of the inner tube 120 and the outer peripheral surface 150A of the bluff body 150 and the inner peripheral surface 110A of the outer tube 110. Furthermore even when the high-temperature inner tube 120 undergoes thermal expansion by reason of a temperature difference between the outer tube 110 and the inner tube 120, deformation or bending can be prevented since the supporting plate 140 which is integrally formed with the inner tube 120 and the bluff body 150 can displace in an axial direction relative to the inner peripheral surface 110A of the outer tube 110.

Figure 12C:
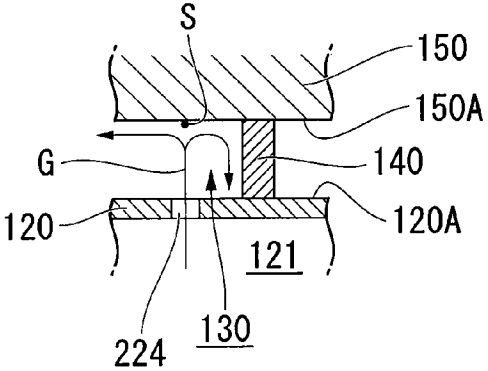
FIG. 12C is an enlarged view of the principal components of a combustion heater according to the ninth embodiment.

In addition, as shown in the partially enlarged view in FIG. 12, combustion gas G which is ejected from the hole part 124 which is positioned furthest towards a distal end collides with the outer peripheral surface 150A of the opposed bluff body 150, forms a stagnation point S on the outer peripheral surface 150A at each hole part 124, and branches along the outer peripheral surface 150A at the stagnation point S. However since the combustion space 130 which is opposed to the hole part 124 is closed by the supporting plate 40, combustion gas G branching towards the supporting plate 140 collides with the supporting plate 140 and then is introduced into the combustion space 130 on the opposite side of the opposed bluff body 150. Consequently, ignition of the peripheral combustion gas G is facilitated by a flame which is retained at the stagnation point S.

Moreover, in the present embodiment, since the combustion space 130 is partitioned by the supporting plate 140, it is possible to avoid a situation in which the combustion gas G accumulates in an uncombusted state in the distal end portion of the outer tube 110 which has a relatively low temperature and results in production of CO.

In addition, in the above embodiment, although the supporting member is configured as a tabular supporting plate 140, the invention is not limited in this respect, and for example, it may employ a supporting member which includes a ring member supported to freely displace in an axial direction on the inner peripheral surface 110A of the outer tube 110 and a rod member which connects the ring member and the inner tube 120 and the bluff body 150.

Figure 11A:
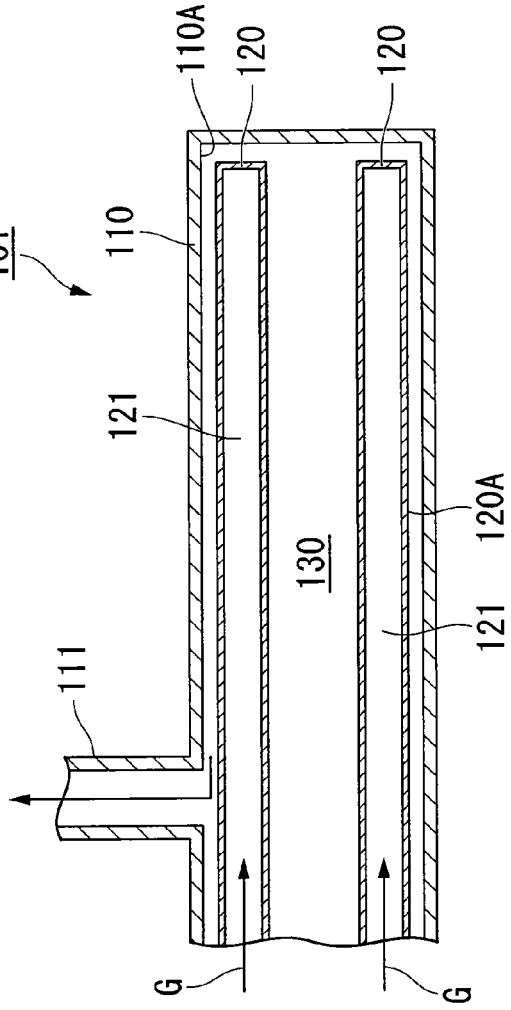
FIG. 11A is a front sectional view of a combustion heater according to an eighth embodiment.

Furthermore in the above embodiment, although a configuration has been described in which the supporting plate 140 is provided on the inner tube 120 and the bluff body 150 as shown in the sixth embodiment, the invention is not limited in this regard and for example, may use the configuration in which a supporting plate is provided in the inner tube 120, 220 as in the seventh embodiment as shown in FIG. 10 or a configuration in which a supporting plate is provided in the inner tube 120 as in the third embodiment as shown in FIG. 11.

In this manner, the same operation and effect as the ninth embodiment are obtained.

(Tenth Embodiment)

Next, a tenth embodiment of the combustion heater 1 will be described making reference to FIG. 13.

The point of difference of the tenth embodiment from the sixth embodiment resides in the fact that a second hole part for reducing gas pressure loss is provided separately to the hole part 124.

Figure 13B:
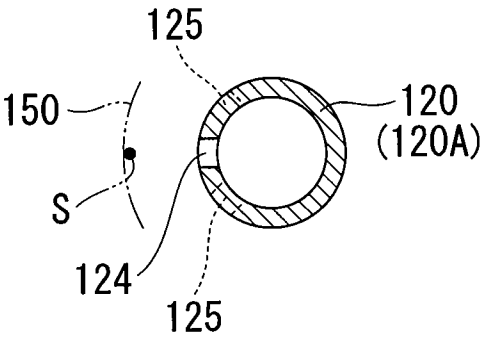
FIG. 13B is a side sectional view of an inner tube of a combustion heater according to the tenth embodiment.
Figure 13A:
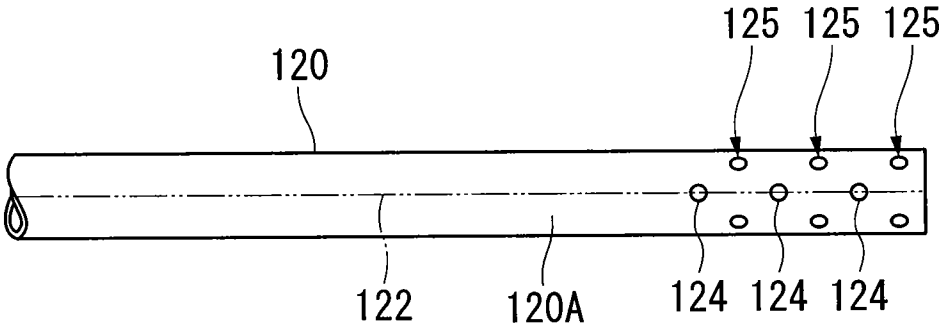
FIG. 13A is a plan view of an inner tube from a bluff body of a combustion heater according to a tenth embodiment.

FIG. 13A is a plan view of an inner tube 120 seen from a bluff body 150 side (central axis of outer tube 10, refer to FIG. 9) and FIG. 13B is a side sectional view.

As shown in FIG. 13A, in the tube wall of the inner tube 120 (outer peripheral surface 120A), a hole part 124 is provided in an axial position 122 facing the central axis of the outer tube 110, and in addition a second hole part 125 is provided alternating with the hole part 124 along the axial position 122 on both sides about the axial position 122.

As shown in FIG. 13B, combustion gas G is ejected from the second hole part 125 towards a position separated from the stagnation point S.

The second hole part 125 is provided at a position of stable propagation of a flame F formed at the stagnation point S in combustion gas G ejected from the second hole part 125.

In other respects, the configuration is the same as the sixth embodiment.

In the combustion heater 101 having the above configuration, a flame which is formed and maintained at a stagnation point S can be propagated in combustion gas G ejected from the second hole part 125 to thereby facilitate combustion of combustion gas under an increased flow rate. As a result, in the present embodiment, pressure loss caused for example by use of a porous body can be avoided. Furthermore the introduced amount of heat can be increased without increasing the length of the inner tube 120, the bluff body 150 and the outer tube 110 to increase the flow amount. As a result, it is possible to prevent an increase in the size of the device resulting for example from increasing the length of the inner tube 120, the bluff body 150 and the outer tube 110. In the present invention, since pressure loss can be suppressed, application is possible to low-pressure city gas lines.

In addition, in the present embodiment, since the hole part 124 and the second hole part 125 are disposed alternately along the axial position 122, and the second hole part 125 is disposed on both sides sandwiching the axial position 122, formation and maintenance of a flame and flame propagation are produced in a stable state with an substantially equal distribution.

The configuration and assembly of each constituent member described in the examples above are merely exemplary and various modifications are possible resulting from design requirements or the like within a scope which does not depart from the present invention.

For example, in the tenth embodiment, although a configuration was described in which a second hole part 125 was provided in addition to the hole part 124 in the combustion heater 101 according to the sixth embodiment, the invention is not limited in this respect, and for example, a configuration of the inner tube 120 (inner tube 220) which is described in the seventh to the ninth embodiments possible to provide a second hole part with the hole part 124. Furthermore a third hole part or more may be provided and a stagnation point and circulating flow formation region can be formed.

In addition, in the sixth embodiment above, a configuration was adopted in which a bluff body 150 which is a stagnation point and circulating flow formation member is disposed concentrically to the outer tube 110, and a plurality of inner tubes 20 is disposed about the central axis of the outer tube 110. However the invention is not limited in this respect, and a configuration is possible in which the inner tube 20 may be disposed concentrically to the outer tube 110, and a plurality of bluff bodies 150 is disposed about the central axis of the outer tube 110. This configuration also obtains the same operation and effect as the sixth embodiment.

Although the preferred embodiments of the present invention have been described above making reference to the attached figures, the present invention of course is not limited thereby. That is to say, various additions, omissions, substitutions and other modifications of the configurations are possible without departing from the present invention. Moreover, the present invention is not limited by the above description but rather is only limited by the scope of the attached claims.

INDUSTRIAL APPLICABILITY

As described above, the present invention enables the formation of a stable flame without resulting in cost increases and improves heating efficiency of a combustion heater.

The invention claimed is:

1. A combustion heater comprising:

an inner tube having a supply passage for combustion gas in an inner portion, an outer tube disposed to provide a separated combustion space in an outer periphery of the inner tube, a hole part for ejecting the combustion gas being formed in a tube wall of the inner tube, and a supporting member that supports a distal end side of the inner tube that is cantilever supported at a base end, between the inner tube and the outer tube, and maintains an interval between an outer peripheral surface of the inner tube and an inner peripheral surface of the outer tube, wherein:

the flow of combustion gas in the combustion space is set to form a stagnation point for combustion gas at a position which faces the hole part on the inner peripheral surface of the outer tube, and to form circulating flow in the periphery of the stagnation point, wherein the hole part is formed at a distal end of the inner tube, and a preheating region in which preheating of the combustion gas is performed in the supply passage using combusted gas is disposed at a base end side of a region of the inner tube in which the hole part is formed, and wherein the supporting member is supported to allow some movement in an axial direction of the outer tube and wherein the supporting member is a plate that partitions the combustion space, thereby avoiding combusted gas accumulating in a distal end of the outer tube.

2. The combustion heater according to claim 1, wherein the supporting member is integrally formed in the inner tube.

3. A combustion heater comprising:

an inner tube having a supply passage for combustion gas in an inner portion, an outer tube disposed to provide a separated combustion space in an outer periphery of the inner tube, a hole part for ejecting the combustion gas being formed in a tube wall of the inner tube, and a supporting member that supports a distal end side of the inner tube that is cantilever supported at a base end, between the inner tube and the outer tube, and maintains an interval between an outer peripheral surface of the inner tube and an inner peripheral surface of the outer tube, wherein:

the combustion gas is ejected with ejection characteristics to form a stagnation point for combustion gas at a position which faces the hole part on the inner peripheral surface of the outer tube and to form circulating flow in the periphery of the stagnation point; wherein the hole part is formed at a distal end of the inner tube, and a preheating region in which preheating of the combustion gas is performed in the supply passage using combusted gas is disposed at a base end side of a region of the inner tube in which the hole part is formed, and wherein the supporting member is supported to allow some movement in an axial direction of the outer tube and wherein the supporting member is a plate that partitions the combustion space, thereby avoiding combusted gas accumulating in a distal end of the outer tube.

4. The combustion heater according to claim 3, wherein:

the outer peripheral surface of the inner tube comprises a first region in which the distance to the inner peripheral surface of the outer tube is shortest and a second region in which the distance is longer than the first region, and the hole part is disposed in the first region and forms a stagnation point for combustion gas on an inner peripheral surface of the outer tube.

5. The combustion heater according to claim 4 wherein:

the inner tube is disposed at an eccentric position to the outer tube, and the hole part is formed on the outer peripheral surface at an eccentric orientation to the inner tube.

6. The combustion heater according to claim 5, wherein a plurality of inner tubes is disposed at an interval in a peripheral direction about the central axis of the outer tube.

7. The combustion heater according to claim 4, wherein:

a second hole part is provided in a position separated from the first region and ejecting combustion gas to a position separated from the stagnation point, and the second hole part is disposed on both sides sandwiching the first region and disposed alternately with the hole part in a direction along the first region.

8. The combustion heater according to claim 3, wherein:

a plurality of hole parts is arranged with an interval in the first region, and the supporting member is provided on both sides in a direction of alignment sandwiching the stagnation point corresponding to the respective hole parts, and has a size which respectively covers the combustion space facing the first region.

9. The combustion heater according to claim 2, wherein the supporting member is integrally formed with the inner tube.

10. A combustion heater comprising:

an inner tube having a supply passage for combustion gas in an inner portion, an outer tube disposed to provide a separated combustion space in an outer periphery of the inner tube, a hole part for ejecting the combustion gas being formed in a tube wall of the inner tube, a member for forming a stagnation point and circulating flow which is formed facing the hole part along an axial direction of the combustion space; and a supporting member that supports a distal end side of the inner tube that is cantilever supported at a base end, between the inner tube and the outer tube, and maintains an interval between an outer peripheral surface of the inner tube and an inner peripheral surface of the outer tube, wherein a stagnation point for combustion gas expelled from the hole part and circulating flow is formed on an outer peripheral surface of the member for forming a stagnation point and circulating flow at a position opposite the hole part, wherein the hole part is formed at a distal end of the inner tube, and a preheating region in which preheating of the combustion gas is performed in the supply passage using combusted gas is disposed at a base end side of a region of the inner tube in which the hole part is formed and wherein the supporting member is supported to allow some movement in an axial direction of the outer tube and wherein the supporting member is a plate that partitions the combustion space, thereby avoiding combusted gas accumulating in a distal end of the outer tube.

11. The combustion heater according to claim 10, wherein:

the member for forming the stagnation point and circulating flow is disposed on a central axis of the outer tube, and a plurality of inner tubes is disposed about the central axis with the hole part facing the central axis.

12. The combustion heater according to claim 11, wherein:

the member for forming the stagnation point and circulating flow has a concave curve formed about an axis of the inner tube at each of the plurality of inner tubes.

13. The combustion heater according to claim 11, wherein:

the member for forming the stagnation point and circulating flow includes a supply passage for combustion gas in an inner section, and the hole part is provided for forming a stagnation point by ejecting combustion gas towards a respective outer peripheral faces of the plurality of inner tubes disposed about the central axis.

14. The combustion heater according to claim 10, wherein:

a plurality of members for forming the stagnation point and circulating flow is provided at an interval in the combustion space, and is an inner tube that forms the hole parts facing the outer peripheral surface of respectively adjacent inner tubes.

15. The combustion heating according to claim 14, wherein:

a plurality of inner tubes is disposed with an interval about a central axis of the outer tube.

16. The combustion heater according to claim 10, wherein:

a second hole part is provided to eject combustion gas to a position separated from the stagnation point in the tube, the second hole part is disposed on both sides sandwiching a region facing the stagnation point and the circulation flow formation member, and is disposed alternating with the hole part in a direction along the facing region.

17. The combustion heater according to claim 10, wherein the supporting member is integrally formed in the inner tube.

* * * * *